United States Patent [19]

Hasegawa

[11] Patent Number: 4,972,236

[45] Date of Patent: Nov. 20, 1990

[54] COMPACT IMAGE FORMING APPARATUS FOR DOUBLE-SIDED AND COMPOSITE COPYING

[75] Inventor: Hirofumi Hasegawa, Osaka, Japan

[73] Assignee: Minolta Camera Kabushiki Kaisha, Osaka, Japan

[21] Appl. No.: 465,618

[22] Filed: Jan. 19, 1990

Related U.S. Application Data

[63] Continuation of Ser. No. 174,885, Mar. 29, 1988, abandoned.

[30] Foreign Application Priority Data

Apr. 1, 1987 [JP] Japan ..... 62-81691

[51] Int. Cl.[5] ..... G03G 21/00

[52] U.S. Cl. ..... 355/319; 355/313; 271/186; 271/291

[58] Field of Search ..... 355/319, 200, 202, 309, 355/318, 321, 26, 24, 313, 3 SH, 14 SH, 3 R, 14 R; 271/186, 291

[56] References Cited

U.S. PATENT DOCUMENTS

| | | | |
|---|---|---|---|
| 4,568,169 | 2/1986 | Woda et al. . | |
| 4,587,532 | 5/1986 | Asano | 355/14 SH X |
| 4,591,884 | 5/1986 | Miyamoto et al. | 355/14 SH X |
| 4,707,713 | 11/1987 | Ayata et al. | 346/140 R |
| 4,783,681 | 11/1988 | Tanaka et al. | 355/14 R |

FOREIGN PATENT DOCUMENTS

| | | | |
|---|---|---|---|
| 59-10958 | 1/1984 | Japan . | |
| 59-90868 | 5/1984 | Japan . | |
| 0222860 | 12/1984 | Japan | 355/14 SH |
| 60-195576 | 10/1985 | Japan . | |
| 0123440 | 6/1987 | Japan | 355/14 SH |

*Primary Examiner*—R. L. Moses

*Attorney, Agent, or Firm*—Wenderoth, Lind & Ponack

[57] ABSTRACT

An image forming apparatus includes several image forming units which are vertically arranged, paper connecting units which connect the paper discharging section of one image forming unit and the paper feeding section of another image forming unit where the two units are vertically adjacent, and a paper separating mechanism to switch the employed paper conveying path from one path to another. Such a structure requires floor space only as much as that required for one image forming unit, and yet provides various functions, e.g. double-sided printing, mulitple copying on one side of a paper with different originials, high-speed printing, multi-colored printing, printed side up discharging, printed side down discharging, job stocking, and sorting. The invention results in a compact and inexpensive image forming apparatus with various high quality fuctions.

31 Claims, 4 Drawing Sheets

COMPACT IMAGE FORMING APPARATUS FOR DOUBLE-SIDED AND COMPOSITE COPYING

This application is a continuation of now abandoned application, Ser. No. 07/174/8865 filed on Mar. 29, 1988.

BACKGROUND OF THE INVENTION

The present invention relates to image forming apparatuses installed in electrophotographic printers, including electrophotographic copying machines.

Recently, there have been two rather conflicting requests from the users of electrophotographic printers whose light sources are either lasers or light-emitting diodes (LED). One is for high quality functions such as double-sided printing, composite copying on one side of a paper, high speed printing, multi-colored printing, and sorting. Another is for compactness, less weight, and inexpensiveness. These are usually considered conflicting since compactness leads to slower printing speed and to fewer functions. In fact, no option unit to upgrade compact electrophotographic printers by adding functions such as double-sided printing and/or composite copying on one side of a paper with different originals is provided.

It has been necessary, therefore, for users to purchase high quality electrophotographic printers besides the compact ones if high quality printing is required. There is indeed a device which comprises two photocopying machines juxtaposed in the paper feeding direction so that papers may flow through the copying machines continuously for double-sided copying or composite copying on one side of a paper with different originals (such as two-colored printing) as disclosed in Japanese Patent Laid Open No. 59-10958 and No. 60-195576, respectively. Each function, however, is limited to double-sided copying or to composite copying on one side of a paper respectively, and also, because the device is no more than two conventional photocopying machine connected, it requires floor space as large as that used for two copying machines.

The present invention, however, provides compact image forming apparatuses that are inexpensive and have several sophisticated functions.

SUMMARY OF THE INVENTION

The main object of the present invention is to provide an image forming apparatus which consists of compact printers, with various functions such as double-sided copying and composite co on one side of a paper with different originals, and yet that are inexpensive.

The second object of the invention is to provide an image forming apparatus with the above-mentioned various functions that requires little floor space.

In order to accomplish the two objects, an image forming apparatus that incorporates the principles of this invention comprises: plural image forming units which are vertically arranged; connecting units which connect the paper discharging section of one image forming unit and the paper feeding section of another image forming unit, where the two units are vertically adjacent; a mechanism for conveying papers from the paper feeding section of one image forming unit to that of another, which consists of several selective path provided in image forming units and in connecting units; and a mechanism for selecting a single paper conveying path from several possible conveying paths.

The third object of the invention is to provide an image forming apparatus with various functions, which consists of compact printers, requires little floor space, and discharges papers through the upper part of the apparatus.

In order to accomplish the above object, an image forming apparatus that incorporates the principles of this invention comprises a paper discharging unit which is attached to the paper discharging section of a top image forming unit, in addition to the above components described as requirements to fulfill the first and the second objects.

Further features and advantages of the invention will be better understood by reference to the following description, and to the drawings forming a part thereof.

BRIEF DESCRIPTION OF THE DRAWINGS

Similarly.

The invention will now be described by reference to the four preferred embodiments of the present invention.

DETAILED DESCRIPTION OF THE INVENTION

Figure 1:
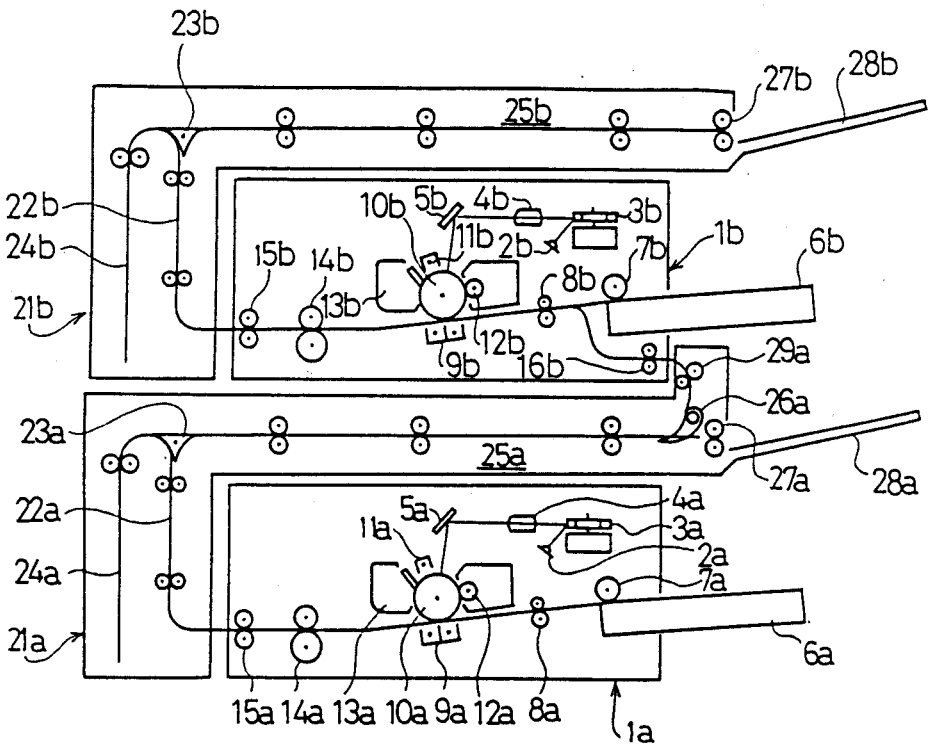
FIG. 1 is a cross-sectional view of the first exemplary image forming apparatus that incorporates a principles of this invention.

The first embodiment which incorporates the principles of the invention is described below referring to FIG. 1.

The embodiment comprises two image forming units 1*a* and 1*b*, each of which is actually a compact printer, a connecting unit 21*a*, and a paper discharging unit 21*b*. They are stacked from bottom to top as follows: image forming unit 1*a*, connecting unit 21*a*, image forming unit 1*b*, and paper discharging unit 21*b*.

In the lower unit, a laser beam, which is emitted from a semiconductor laser 2*a* and controlled by an image controller not shown in the figure, i scanned with a polygon mirror 3*a* to reach a lens 4*a* and then a reflecting mirror 5*a* so that an image is formed on a photoconductive drum 10*a*. The drum 10*a* is electrified by a charger 11*a* to form an electrostatic latent image by the laser beams, which is developed by a developing device 12*a*, and finally, a visible image is transferred onto a paper by a transferring charger 9*a* and residual toner is removed by a cleaner 13*a*. Papers are fed from a paper feeding cassette 6*a* by a paper feeding roller 7*a* to a transferring section and synchronized with the image formed on the photoconductive drum 10*a* by a timing roller 8*a*. The paper, which has the image transferred thereto at the transferring section, has the printing fixed by a fixing roller 14*a* and is discharged from the image forming unit 1*a* by a paper discharging roller 15*a*.

In the connecting unit 21*a*, the paper discharged from the paper discharging roller 15*a* is sent to a first paper separating claw 23*a*, via a vertical path 22*a*, and is further guided to either a paper reversing path 24*a* or a conveying path 25*a*. In case the paper is guided to the reversing path 24*a*, it is reversed and sent to the conveying path 25a. After going through the conveying path 25a, the paper is sent to a second paper separating claw 26a and further to either of two paths, which are described below, via a first discharging roller 27a. One of the paths discharges the paper to the paper discharging tray 28a, which forms an intermediate discharging section. Another sends the paper to the paper circulating roller 16b in the upper image forming unit 1b.

Similar to the lower image forming unit la, the upper image forming unit 1b consists of a semiconductor laser 2b, an image controller not shown in the figure, a polygon mirror 3b, a lens 4b, a reflecting mirror 5b, a paper feeding cassette 6b, a paper feeding roller 7b, a timing roller 8b, a copying charger 9b, a photoconductive drum 10b, a charger 11b, a developing device 12b, a cleaner 13b, a fixing unit 14b, and a paper discharging roller 15b, and forms an image in an exactly the same way as the lower image forming unit. The upper image forming unit 1b, unlike the lower 1a, has a paper circulating roller 16b, whose purpose is to guide the paper discharged from the connecting unit 21a to the timing roller 8b. However, the lower image forming unit 1a may be equipped with a paper circulating roller to make the two units interchangeable.

The paper discharging unit 21b consists of a vertical path 22b, a first separate claw 23b, a conveying path 25b, and a first discharging roller 27b, as in the connecting unit 21a; the shapes of the casings, the structures of the paper discharge areas and the connecting units are almost identical. It should be noted, however, that the connecting unit further comprises a second paper separating claw 26a and a second discharging roller 29a, the discharging unit comprises only one paper separating claw 23b and one discharging roller 27b. It is not that the paper discharging unit should be devoid of a second paper separating claw and a second discharging roller. Both of them may be equipped with these features, so that the paper discharging unit would be identical to, and thus interchangeable with, the connecting unit.

Using such an apparatus, the paper discharged from the lower image forming unit 1a has two options. It can be guided to the conveying path 25a via the first paper separating claw 23a in the lower image guiding unit 1a. In this case, the printed side of the paper is faced down. Or, it can be guided to the reversing path 24a to be reversed so that the printed side faces up, and then to the conveying path 25a. In both cases, the paper may either be sent to image forming unit 1b by the second paper separating claw 26a or be discharged to the paper discharging tray 28a. The papers discharged on the paper discharging tray 28a have their printed side facing up if they came through the reversing path 24a, and printed side facing down if they did not come through the path Now the papers requiring high quality printing, such as double-sided printing, are sent to the upper image forming unit 1b. Those that went through the reversing path 24a have their printed side down when they are circulated to the upper unit 1b in order to have both sides printed. The others that did not go through the reversing path 24a will be printed twice on one side: once in the lower image forming unit 1a and again the upper 1b; but the data to be printed in the upper apparatus may be different from that printed in the lower apparatus. Also, two-colored printing can be accomplished by applying toner of a different color to each image forming unit. Similarly, three vertically arranged image forming units will yield three-colored materials.

As described above, the flow of papers through vertically arranged image forming units make various functions possible: discharging papers printed side up or down, whichever desired; double-sided printing; printing two different data on one side as a single operation; and multi-colored copying.

There is another attractive feature of the invention; when the two image forming units 1a and 1b are operated simultaneously but independently, they may serve as two printers engaged in completely different jobs. That is, high-speed printing and job stocking and sorting become possible by using two units which have their own discharging trays 28a, 28b. The assembly of plural independent units also allows one of the units to be out of order while others perform their tasks; the reliability of the copying machine as a whole is increased.

Finally, the vertical arrangement of image forming units requires floor space only as large as that required for one unit. Such an arrangement may also turn out to be useful, as the users can collect all the printed copies without moving around.

Figure 2:
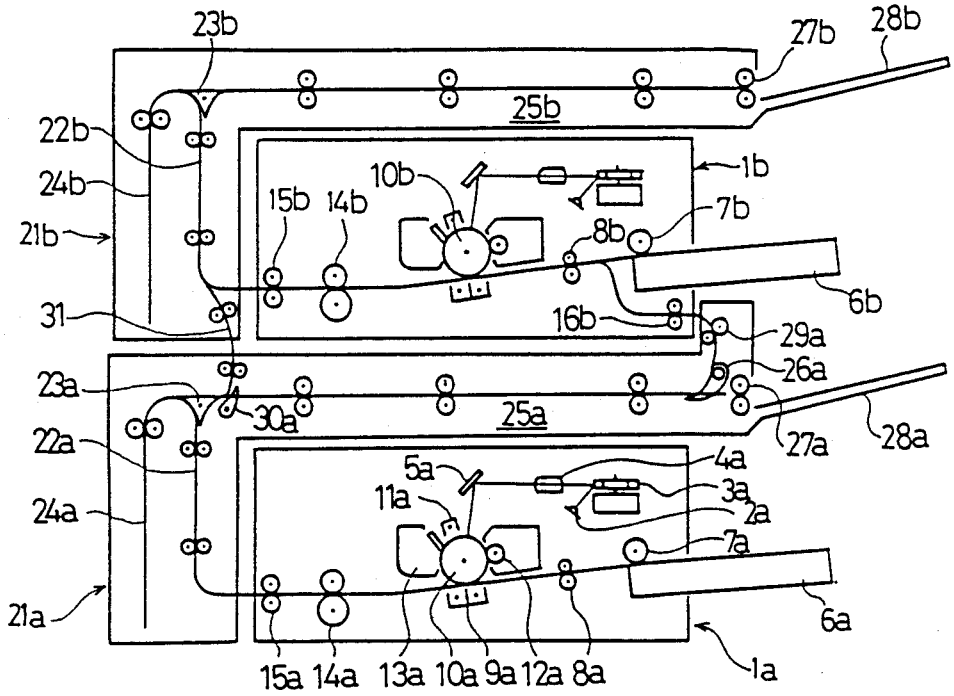
FIGS. 2, 3, and 4 are crosssectional views of second, third, and fourth exemplary image forming apparatuses, respectively, that incorporate the principles of this invention. The subscripts 'a' and 'b' in the figures show that the parts belong to the lower or to the upper image forming unit, respectively. A short-cut path 31 in FIG. 2 traverses two vertically adjacent image forming units, and thus, neither 'a' or 'b' accompanies the number that designates the path.

The principles of this invention can be applied as shown in FIG. 2. The second embodiment is identical to the first, expect that the second embodiment has four paper separating claws 23a, 23b, 26a, 30a, while the first has only three 23a, 23b, and 2a, it has a short-cut path 31 while the first embodiment does not.

The connecting unit 21a is now equipped with a third paper separating claw 30a in such a place that the papers may encounter the claw 30a after the first paper separating claw 23a. The connecting unit 21a and the lower end of the vertical path 22a of the paper discharging unit 21b are connected with the short-cut path 31. The papers that were printed in the lower image forming unit 1a are sent to the connecting unit 21a and eventually either to upper paper discharging tray 28b via the short-cut path 31 and a paper discharging unit 21b or to lower paper discharging tray 28a. Since the papers are discharged to the upper discharging tray 28b without going through the image forming unit 1b due to the shortcut path 31, desirable sorting can be accomplished speedily.

Figure 3:
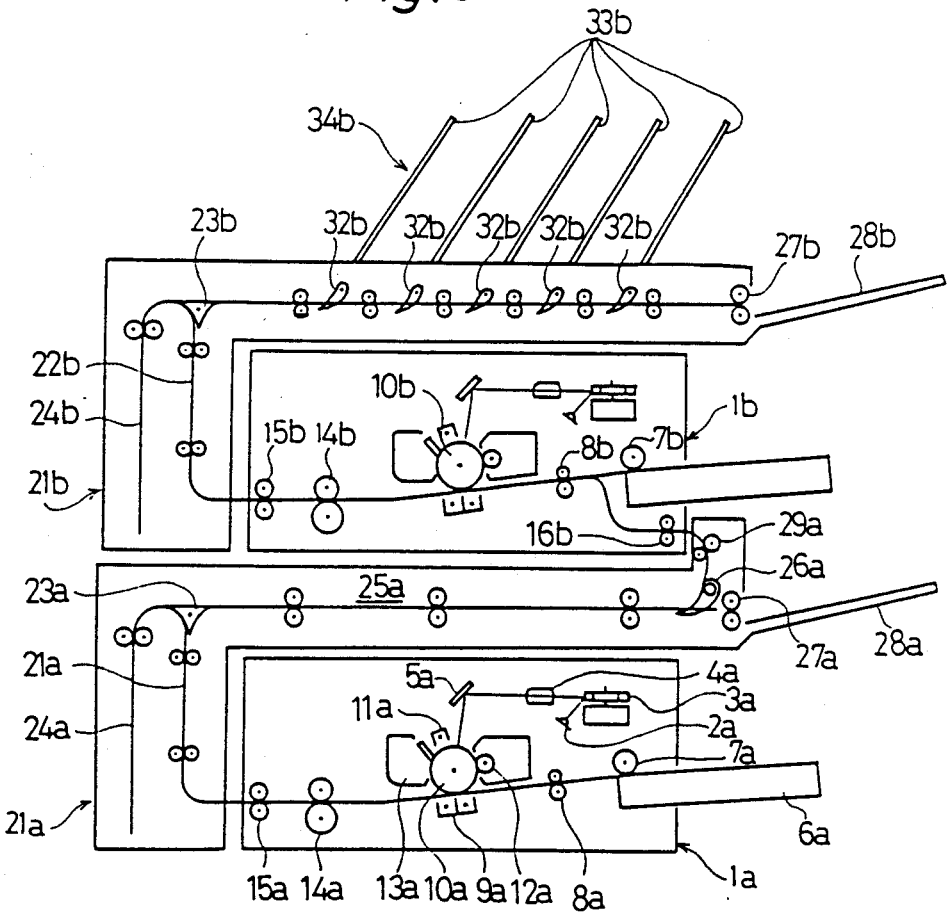

The third embodiment illustrated in FIG. 3 has an identical structure to the first embodiment except that the embodiment has several paper separating claws 32b along the conveying path 25b of the upper image forming unit 1b and an accompanying discharged paper tray 33b for each claw (the trays 33b are named sorting section 34b as a whole). Therefore, a sorting function becomes available and the printed materials are sorted into as many groups as the number of pairs of separating claws and trays.

Figure 4:
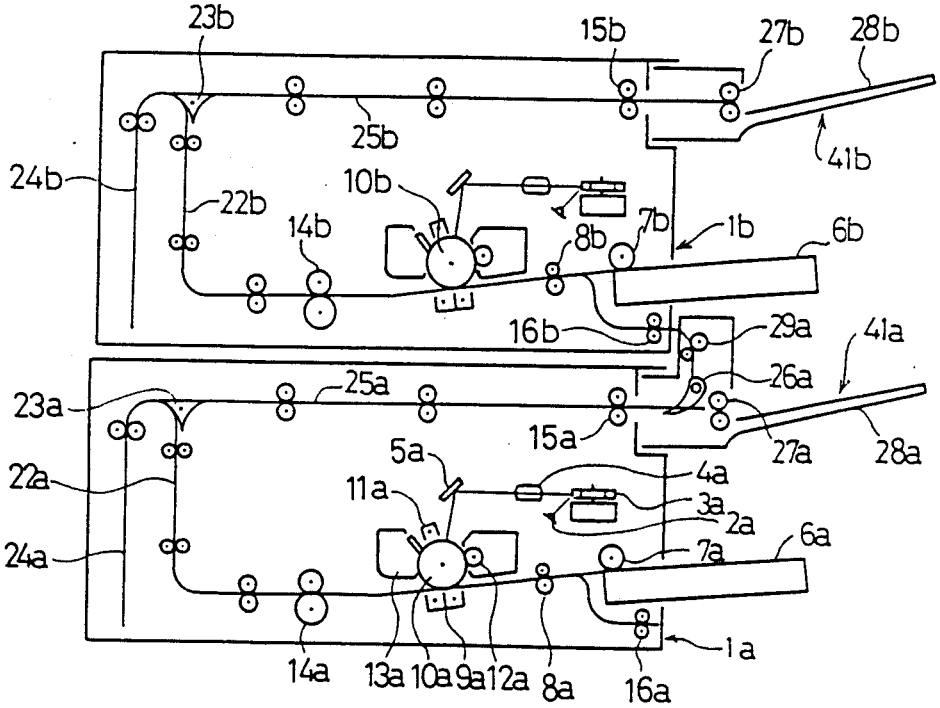

Although the above three embodiments were provided with vertical paths, conveying paths, and first and second paper separating claws as parts of paper guiding units, not all of them are required to obtain the merits of the invention. For example, in a fourth embodiment shown in FIG. 4, the connecting unit 21a has to be equipped only with a second paper separating claw 26a, a first discharging roller 27a, a second discharging roller 29a, and a paper discharging tray 28a, and the discharging unit only with a discharging roller 27b and a discharging tray 28b, if each of the image forming units 1a and 1b has a vertical path 22a, 22b, a reversing path 24a, 24b, a conveying path 25a, 25b, and a first paper separating claw 23a, 23b. In other words, the connecting and the paper discharging units are reduced to exclude paper paths, and the excluded paths are included in the image forming units. However, if there is no need to reverse the paper with a reversing path, the image forming units 1*a* and 1*b* should be equipped with vertical paths 22*a*, 22*b* and conveying paths 25*a*, 25*b* but not necessarily with first paper separating claws and reversing paths.

In addition, an image forming unit can be made into one with either a connecting or a paper discharging unit, and, more than two image forming units may be further vertically arranged and connected.

While the present invention has been described in connection with certain specific embodiments, it is to be understood that it is not to be limited to those embodiments. On the contrary, it is intended to cover all alternatives and modifications falling within the spirit and scope of the invention as set forth in the appended claims.

What is claimed is:

1. An image forming apparatus comprising:

plural image forming units, each of said units having paper feeding means provided on one side thereof;

an image forming means in each said unit for forming an image on a paper supplied from said paper feeding means and paper discharging means provided on another side of each said unit opposite to said paper feeding means for discharging the paper on which an image has been formed at said image forming means, said plural units being vertically arranged directly over one another to position said paper feeding means of said plural units on the same sides of said units; and at least one connecting unit provided between two of said image forming units, said two image forming units having a space therebetween, and said connecting unit having a paper conveying path means for conveying papers from said paper discharging means of one of said image forming units to said paper feeding means of the second said image forming unit through said space between said two image forming units.

2. The image forming apparatus of claim 1, wherein each of said plural image forming units and said connecting unit is detachable from the other said image forming units and connecting units.

3. The image forming apparatus of claim 2, wherein said connecting unit comprises:

plural selective path means for conveying papers; and means for selecting a single paper conveying path means from said plural selective path means.

4. The image forming apparatus of claim 3, wherein said selective path means include:

a paper reversing path means for reversing a paper being conveyed so that images are formed on both sides of the paper; and an unreversing path means for conveying papers without reversing them.

5. The image forming apparatus of claim 2, wherein said connecting unit comprises:

an intermediate discharging section;

a paper discharging path means diverging from said paper conveying path means for guiding paper to said intermediate discharging section; and a means for selecting either said paper conveying path means or said paper discharging path means at the point of divergence of said paper discharging path means from said paper conveying path means.

6. An image forming apparatus comprising:

plural image forming units vertically disposed directly over one another and each having a paper feeding section for feeding papers in the same direction as one another for image formation by each of said units, each said unit further having a paper discharging section for discharging the papers;

a connecting unit which connects the paper discharging section of the lower image forming unit and the paper feeding section of the upper image forming unit for conveying papers from said paper discharging section of said lower image forming unit to said paper feeding section of said upper image forming unit; and a paper discharging unit attached to said paper discharging section of said upper image forming unit.

7. The image forming apparatus of claim 6, wherein said paper discharging unit is placed on said upper image forming unit.

8. The image forming apparatus of claim 7, and further comprising:

a paper conveying path means in said connecting unit for conveying papers to said paper discharging section of said lover image forming unit;

a short-cut path means connecting said connecting unit attached to said lower image forming unit and said paper discharging unit attached to said upper image forming unit where said plural units are vertically adjacent; and a means provided in said connecting unit for selecting either said short-cut path or said paper conveying path in said connecting unit.

9. The image forming apparatus of claim 6, wherein said paper discharging unit comprises:

a paper reversing path means for reversing the papers being conveyed;

a conveying path means for conveying papers without reversing them; and a means for selecting either of said paper conveying path means and said paper reversing path means.

10. The image forming apparatus of claim 6, wherein said paper discharging unit comprises:

a main path means for guiding papers to said paper discharging section of said upper image forming unit;

a sorting path means diverging from said main path means for conveying papers to a sorting section; and a means for selecting either said two paper path means.

11. An image forming apparatus, comprising:

plural image forming units, each of said units having a paper feeding section provided on one side of said unit;

each said image forming unit further including an image forming section for forming an image on a paper supplied from said paper feeding section and a paper discharging section provided on the same side of said unit as said paper feeding section for discharging the paper on which an image has been formed at said image forming section, said plural units being vertically arranged to dispose said paper feeding sections of said plural image forming units on the same sides of said units; and at least one connecting unit having a path means for conveying papers from a said paper discharging section of a first said image forming unit to a said paper feeding section of another of said image forming units arranged on said first image forming unit.

12. The image forming apparatus of claim 11, wherein each of said plural image forming units and said connecting unit is detachable from the other said image forming units and connecting units.

13. An image forming apparatus, comprising:

plural printers, each of said printers having means for conveying a paper horizontally and an image forming means for forming an image on a paper being conveyed by said conveying means, said plural printers being vertically arranged directly above one another to position each of said conveying means to convey the paper in the same direction; and at least one connecting unit having a conveying path means for conveying papers discharged from one of aid printers and for supplying the papers to the conveying means of another said printer.

14. The image forming apparatus of claim 13, wherein said connecting unit comprises:

plural selective path means for conveying papers; and means for selecting a single said path means from said plural selective path means.

15. The image forming apparatus of claim 14, wherein said plural selective path means include;

a paper reversing path means for reversing a paper being conveyed so that images are formed on both sides of the paper; and an unreversing path means for conveying papers without reversing them.

16. The image forming apparatus of claim 13, wherein said connecting unit comprises:

an intermediate discharging section;

a paper discharging path means diverging from said conveying path means for guiding paper to said intermediate discharging section; and a means for selecting either said conveying path means or said discharging path means at the point of divergence of said paper discharging path means from said paper conveying path means.

17. The image forming apparatus of claim 13, wherein each said printer comprises:

a paper discharging section;

plural selective path means for conveying papers which have images copied thereon to said paper discharging section; and means for selecting one of said plural selective path means.

18. The image forming apparatus of claim 17, wherein said plural selective path means include:

a paper reversing path means for reversing the paper being conveyed so that images are formed on both sides of the paper; and an unreversing path means for conveying papers without reversing them.

19. The image forming apparatus of claim 13, wherein each of said plural printers and said connecting unit is detachable from the other said printers and connecting units.

20. The image forming apparatus of claim 19, wherein said image forming means of said one printer forms an image on the upper side of a paper, said one printer having means for upwardly transporting the paper on which an image has been formed, and discharging means provided above said image forming means for discharging the paper with the side having the image thereon facing down, said connecting unit conveying the paper from said one printer to another printer above said one printer.

21. The image forming apparatus of claim 13, wherein each of said image forming means forms an image on the upper side of a paper, and said image forming apparatus further comprises:

means for turning over the paper on which the image has been formed by said image forming means of said one of the printers so that the side having the image thereon faces down;

transporting means for transporting the paper having the side with the image thereon facing down horizontally in the direction opposite to the paper conveying direction of said conveying means; and means for turning over the paper which has been transported by said transporting means so that the side having the image thereon faces up to feed the paper to the image forming means of said another printer.

22. An image forming apparatus, comprising:

first and second image forming units, each of said units having a paper feeding section provided on one side of said unit;

a paper discharging section provided on another side of each said unit opposite to said paper feeding section;

paper transporting means in each said unit for transporting papers horizontally from said paper feeding section to said paper discharging section;

an image forming means in each said unit for forming images on papers transported by said paper transporting means;

said second image forming unit positioned over said first image forming unit so that the transporting direction of said second image forming unit is the same as the transporting direction of said first image forming unit; and a connecting unit having a first conveying path means for leading papers discharged from said first image forming unit upward, a second conveying path means for horizontally conveying the papers led by said first conveying path means through a space between said first and said second image forming units in the direction opposite to said transporting direction of said paper transporting means, and a third conveying path means for conveying the papers which have been conveyed by said second conveying path means to said paper feeding section of said second image forming unit.

23. The image forming apparatus of claim 22, wherein said first and said second image forming units and said connecting unit are detachable from each other.

24. The image forming apparatus of claim 23, wherein said connecting unit comprises:

plural selective path means for conveying papers; and means for selecting a single said path means from said plural selective path means.

25. The image forming apparatus of claim 24, wherein said plural selective path means include:

a paper reversing path means for reversing the paper being conveyed so that images are formed on both sides of the paper; and an unreversing path means which conveys papers without reversing them, said unreversing path means comprising said first conveying path means of said connecting unit.

26. A connecting apparatus connecting plural image forming apparatus that are vertically arranged directly over one another such that paper conveying direction of all of said image forming apparatus are the same, comprising;

a paper conveying path means for conveying papers discharged from one of said image forming apparatus to another of said image forming apparatus.

27. The connecting apparatus of claim 26, wherein said one image forming apparatus has a paper discharging section and another upper said image forming apparatus has a paper feeding section, said paper conveying path means connecting said paper discharging section of said one image forming apparatus and said paper feeding section of said another image forming apparatus to thereby convey papers through said conveying path means from said one image forming apparatus to said another image forming apparatus.

28. The connecting apparatus of claim 27, wherein said connecting apparatus is disposed on said one image forming apparatus, and said another image forming apparatus is positioned over said connecting apparatus.

29. The connecting apparatus of claim 28, wherein:

said connecting apparatus spaces said one image forming apparatus from said another image forming apparatus; and said paper conveying path means conveys the paper through the space between said one and said another image forming apparatus.

30. The connecting apparatus of claim 29, and further comprising:

a paper reversing path means for reversing papers being conveyed so that images can be formed on both sides of the papers;

an unreversing path means for conveying papers without reversing the papers; and means for selecting one of said paper reversing path means and said unreversing path means.

31. An image forming apparatus, comprising:

a first image forming unit having a first paper feeding section for feeding papers one by one;

said first image forming unit including an image forming means for forming an image on a first side of a paper fed from said first paper feeding section and a first discharging section for discharging the paper from said first image forming unit;

a second image forming unit vertically disposed directly above said first image forming unit and including a second paper feeding section for feeding paper;

said second image forming unit further including an image forming means for forming an image on the paper fed from said second paper feeding section and a second discharging section for discharging the paper from said second image forming unit;

a connecting means disposed between said first and said second image forming units for forming a paper path leading the paper from said first discharging section to said second paper feeding section; and selective means having a composite image forming mode and a duplex mode for guiding a paper formed with a image on a first side thereof in said first image forming unit to said second image forming unit through said connecting means to form an additional image either on the same side or the rear side of the paper fed from said first image forming unit depending on whether said selective means is in said composite image forming mode or said duplex mode, respectively.

* * * * *